US010435123B2

(12) United States Patent
Volny et al.

(10) Patent No.: US 10,435,123 B2
(45) Date of Patent: Oct. 8, 2019

(54) AUTO ERECTED BALLAST BAGS

(71) Applicant: GOODRICH CORPORATION, Charlotte, NC (US)

(72) Inventors: Jaro S. Volny, Scottsdale, AZ (US); Drew Hartman, Phoenix, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 146 days.

(21) Appl. No.: 15/684,167

(22) Filed: Aug. 23, 2017

(65) Prior Publication Data

US 2019/0061887 A1 Feb. 28, 2019

(51) Int. Cl.
*B63C 9/04* (2006.01)
*B63B 7/08* (2006.01)

(52) U.S. Cl.
CPC ..... *B63C 9/04* (2013.01); *B63B 7/08* (2013.01); *B63C 2009/042* (2013.01)

(58) Field of Classification Search
CPC ..... B63B 7/08; B63B 7/082; B63B 21/24; B63B 21/29; B63B 21/48; B63B 39/02; B63B 39/03; B63C 9/02; B63C 2009/023; B63C 2009/026; B63C 9/03; B63C 2009/035; B63C 9/04; B63C 2009/042; B63C 2009/044; B63C 2009/046; B63C 2009/048; B63C 9/05
See application file for complete search history.

(56) References Cited

U.S. PATENT DOCUMENTS 2,444,859 A * 7/1948 Sturtevant ..... B63B 7/08 206/335
2,784,425 A * 3/1957 Bicknell ..... B63B 21/48 114/311
3,811,285 A * 5/1974 Ballu ..... E02B 15/08 405/69
3,899,797 A * 8/1975 Gunst ..... A47C 4/54 5/655.3
4,001,905 A * 1/1977 Givens ..... B63C 9/06 441/37
4,280,239 A * 7/1981 Brown ..... B63C 9/04 441/42
4,295,755 A * 10/1981 Meyers ..... E02B 15/08 405/63
5,197,821 A * 3/1993 Cain ..... E02B 15/08 405/68
6,135,046 A * 10/2000 Beech ..... B63B 21/48 114/311
6,609,726 B1 8/2003 Stutz et al.
9,221,526 B2 12/2015 Arias

FOREIGN PATENT DOCUMENTS

GB 1336830 11/1973

* cited by examiner

*Primary Examiner* — Ajay Vasudeva
(74) *Attorney, Agent, or Firm* — Snell & Wilmer, L.L.P.

(57) ABSTRACT

A ballast bag includes a top portion, a center portion coupled to the top portion, a bottom portion coupled to the center portion, and a spring coupled to the top portion and the bottom portion and encapsulated by the center portion, the spring being capable of expanding the ballast bag from a compact state to an erect state, the ballast bag being capable of retaining water in the erect state.

8 Claims, 4 Drawing Sheets

AUTO ERECTED BALLAST BAGS

FIELD

The present disclosure relates generally to life rafts and more specifically to ballast bags for life rafts.

BACKGROUND

Inflatable life rafts may comply with various aerospace standards and generally utilize water pockets or ballast bags for stabilization. The water pockets or ballast bags are generally filled to sixty percent of their total volume within twenty five seconds of being immersed into fresh water. Materials used in life-raft production are typically light weight to reduce aircraft weight and often are generally buoyant. Additionally, the ballast bags are packed tightly and stowed with the rest of the life raft for extended periods of time. During the extended time period, the ballast bag material sets and takes the form of its packed condition, potentially reducing the likelihood that the ballast bags unfold and entrain water to sixty percent of their volume in twenty seconds or less.

SUMMARY

A ballast bag includes a top portion, a center portion coupled to the top portion, a bottom portion coupled to the center portion, and a spring coupled to the top portion and the bottom portion and encapsulated by the center portion, the spring configured to push the top portion and the bottom portion away from the center portion.

In various embodiments of the ballast bag, the spring is a cylindrical spring.

In various embodiments of the ballast bag, the spring is integrated into a center portion of the ballast bag.

In various embodiments of the ballast bag, the center portion is a tubular center portion whose diameter matches a diameter of the spring.

In various embodiments of the ballast bag, the spring is in an unrotated position to be in a compact state and a rotated position to be in an erect state.

In various embodiments of the ballast bag, the ballast bag is in the compact state when a life raft coupled to the ballast bag has not been deployed.

In various embodiments of the ballast bag, the ballast bag is in the erect state when a life raft coupled to the ballast bag has been deployed.

In various embodiments of the ballast bag, the ballast bag is released from the compact state when a life raft coupled to the ballast bag is deployed.

In various embodiments, an evacuation system includes a life raft and a ballast bag coupled to the life raft, wherein the ballast bag is capable of expanding from a compacted state to an erected state.

In various embodiments of the evacuation system, wherein a spring is integrated into the ballast bag.

In various embodiments of the evacuation system, the spring is capable of expanding the ballast bag from the compacted state to the erected state.

In various embodiments of the evacuation system, the spring is a cylindrical spring.

In various embodiments of the evacuation system, the ballast bag includes a tubular center portion whose diameter matches a diameter of the spring.

In various embodiments of the evacuation system, the spring is unrotated to yield the compacted state and rotated to yield the erected state.

In various embodiments of the evacuation system, the ballast bag is in the compacted state when the life raft is packaged.

In various embodiments of the evacuation system, the ballast bag is in the erected state when the life raft coupled to the ballast bag is deployed.

In various embodiments of the evacuation system, a pressure is released from a package holding the life raft and the ballast bag in the compacted state to expand the ballast bag to the erected state.

In various embodiments, a method of erecting a ballast bag includes placing the ballast bag in a compact state, rotating a top portion of the ballast bag, and erecting the ballast bag from the compact state to an erected state using a spring coupled to the top portion of the ballast bag.

In various embodiments, the method further includes, rotating the top portion of the ballast bag in a counter-clockwise direction.

In various embodiments, the method further includes placing the ballast bag on a perimeter of a life raft.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein. Thus, the detailed description herein is presented for purposes of illustration only and not of limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step.

Figure 1:
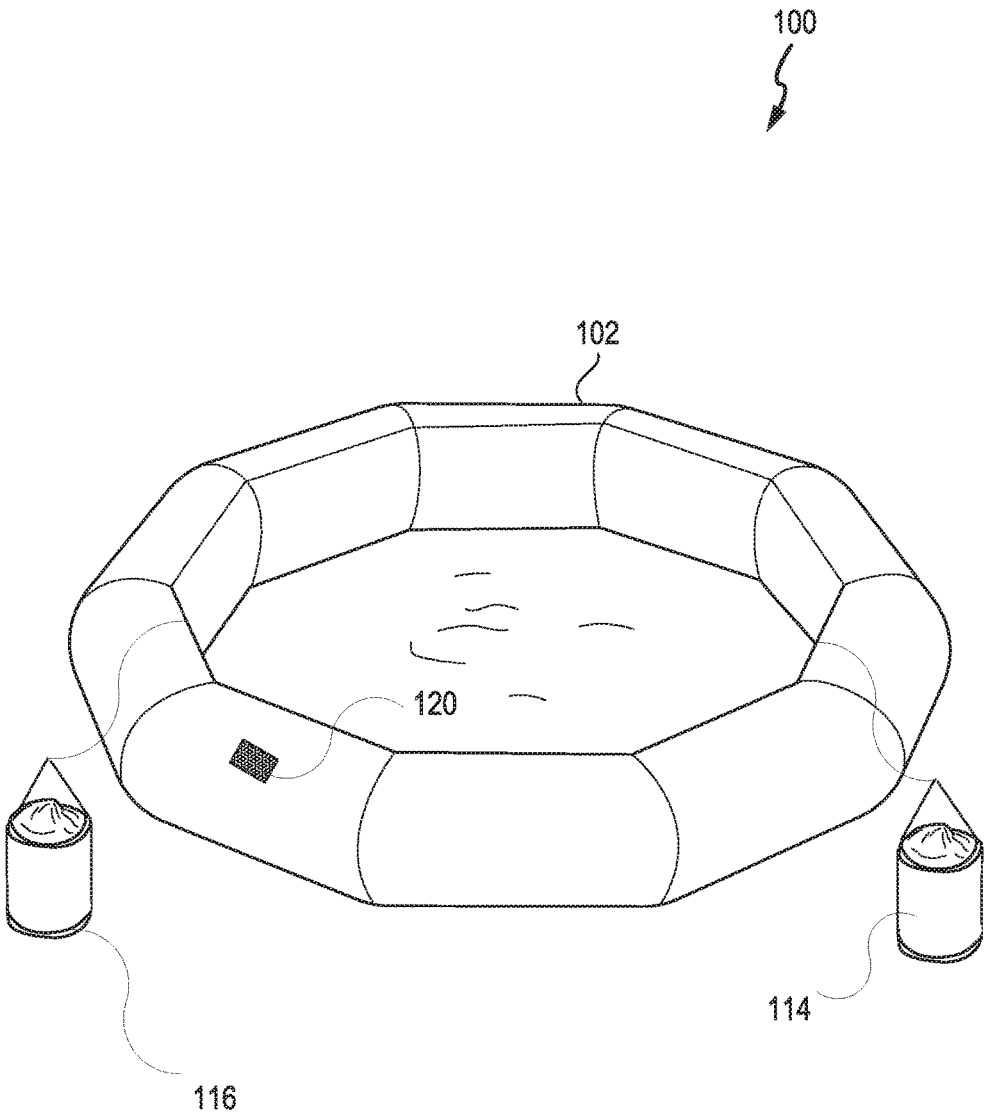
FIG. 1 illustrates, in accordance with various embodiments, an evacuation system.

With regards to FIG. 1, an evacuation system 100 is depicted according to various embodiments. Evacuation system 100 includes a life raft 102, a first ballast bag 114, a second ballast bag 116, and an inflation system 120. In various embodiments, first ballast bag 114 and second ballast bag 116 are coupled to life raft 102. In various embodiments, first ballast bag 114 and/or second ballast bag 116 may be, for example, cylindrically shaped, square shaped, or various other shapes that allow first ballast bag 114 and/or second ballast bag 116 to retain water. In various embodiments, ballast bags 114 and/or 116 may be made of, for example, nylon, ballistic nylon, polypropylene, polyester, cotton, or any other suitable material, whether coated or uncoated. In various embodiments, ballast bags 114 and/or 116 may be made of a nylon based textile having a coating, the coating comprising a polymeric material such as polyurethane, neoprene, or the like. In various embodiments, ballast bags 114 and 116 may be designed to weigh, for example, one to twenty pounds, five to twenty-five pounds, or ten to thirty pounds depending on the amount of water ballast bags 114 and 116 are designed to support.

Inflation system 120 may be coupled to life raft 102 and/or first ballast bag 114 and/or second ballast bag 116. Inflation system 120 may include a compressed gas cylinder and an aspirator, where the aspirator entrains ambient air for use by life raft 102. In various embodiments, a pressure relief valve may be coupled to a relief valve of life raft 102 to release excess pressure from life raft 102. Pressure may be released depending on, for example, life raft 102 being deployed in environments with extreme temperatures. Pressures accumulated in life raft 102 may be greater in environments with increased temperatures or lower in temperatures where life raft 102 is deployed in cold environments. In various embodiments, a pressure relief valve may also be used to normalize the pressure at different operating conditions.

In various embodiments, first ballast bag 114 and second ballast bag 116 may be placed along or coupled to the perimeter of life raft 102. Additional ballast bags may be placed along the perimeter of life raft 102 or in other various locations of life raft 102. In various embodiments, prior to deployment of life raft 102, first ballast bag 114 and second ballast bag 116 may be packaged with life raft 102. First ballast bag 114 and second ballast bag 116, may, for example, be placed upon or within packaged life raft 102.

During operation, prior to deployment, life raft 102 and first ballast bag 114 are packed into a package or life raft container. Upon deployment of life raft 102, first ballast bag 114 and second ballast bag 116 are positioned on the perimeter of life raft 102. From a compact state, the top portion of ballast bags 114 and 116 (which includes the top portion of spring 210 (referring momentarily FIG. 2)) in each first ballast bag 114 and 116, may be rotated to activate spring 210 embedded into ballast bags 114 and 116. After activation of spring 210 embedded in ballast bags 114 and 116, which, as stated previously, may occur by rotating the top portion of spring 210, ballast bags 114 and 116 may erect themselves into, for example, an erect shape, such as, for example, a bucket shape or cylindrical shape that allows water to be inserted into the cavities of ballast bags 114 and 116 in order to stabilize life raft 102. Passengers may use erect ballast bags 114 and 116 to support life raft 102 and prevent life raft 102 from tipping over.

Figure 2:
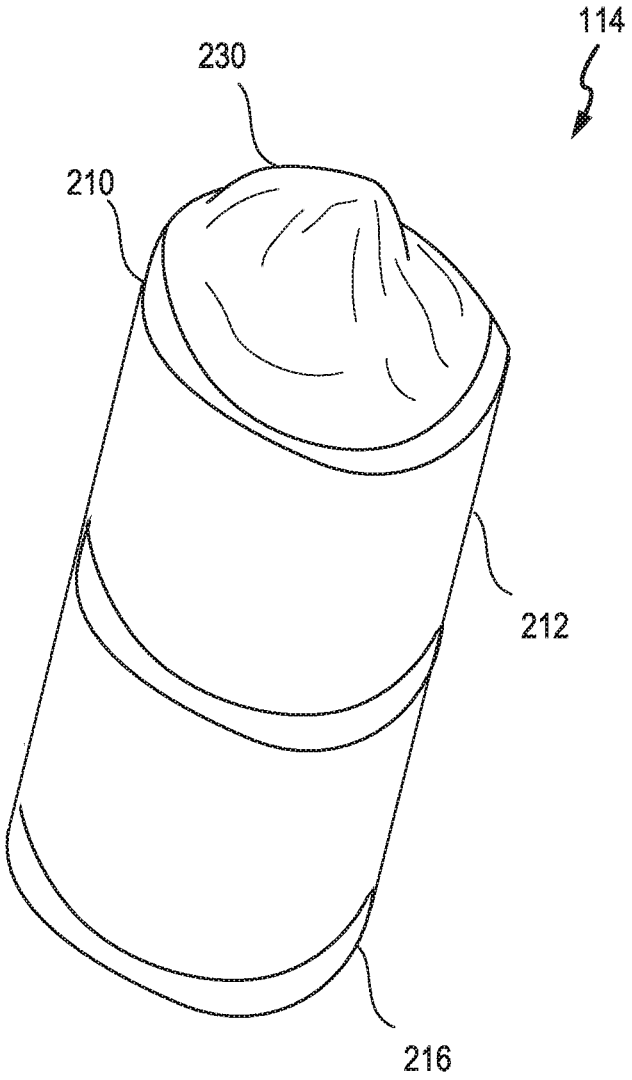
FIG. 2 illustrates, in accordance with various embodiments, a closer view of the ballast bag.

With regards to FIG. 2, first ballast bag 114 is depicted according to various embodiments. First ballast bag 114 includes a spring 210, a top portion 230, a center portion 212, and a bottom portion 216. In various embodiments, top portion 230 is coupled to center portion 212. Center portion 212 is coupled to bottom portion 216. Top portion 230 serves as the top of first ballast bag 114, where, for example, water may be filled into first ballast bag 114. Bottom portion 216 is the bottom of first ballast bag 114 and serves as the base of first ballast bag 114. Center portion 212 may be cylindrical in shape and combines with bottom portion 216 and top portion 230 to provide support for spring 210. In various embodiments, center portion 212 has a tubular shape whose diameter may be equal to a diameter of spring 210. Spring 210 may be integrated into center portion 212, which may be made from, for example, nylon, ballistic nylon, polypropylene, polyester, cotton, or any other suitable material, whether coated or uncoated. In various embodiments, center portion 212 may be made of a nylon based textile having a coating, the coating comprising a polymeric material such as polyurethane, neoprene, or the like, which may be capable of retaining water.

In various embodiments, center portion 212 envelopes spring 210 to allow spring 210 to remain in a compact state when not deployed, and an erect state when deployed. That is, spring 210 is integrated into first ballast bag 114 to allow first ballast bag 114 to be erected from a folded or compacted state to an erected state after life raft 102 has been deployed. Spring 210 may be, for example, a diameter that matches or equals the diameter of first ballast bag 114. In various embodiments, spring 210 may be integrated into the fabric of first ballast bag 114. Spring 210 may be, for example, made from spring steel or a plastic material. Spring 210 may be the shape of a helical coil. Spring 210 may be compressed in response to packing or spring 210 may be a folding type spring or a foldable spring that may be folded during packing and restrained by the rest of the package. Spring 210 may allow first ballast bag 114 to open automatically by rotating the top portion of spring 210 when the package holding life raft 102 and first ballast bag 114 is deployed. In various embodiments, the non-rotation of spring 210 keeps spring 210 in compression until rotation of spring 210 occurs.

In various embodiments of first ballast bag 114, spring 210 is in an unrotated position when ballast bag is in a compact state and a rotated position to be in an erected state. The first ballast bag 114 is in a compact state when life raft 102 is coupled to first ballast bag 114 and has not been deployed.

Figure 3A:
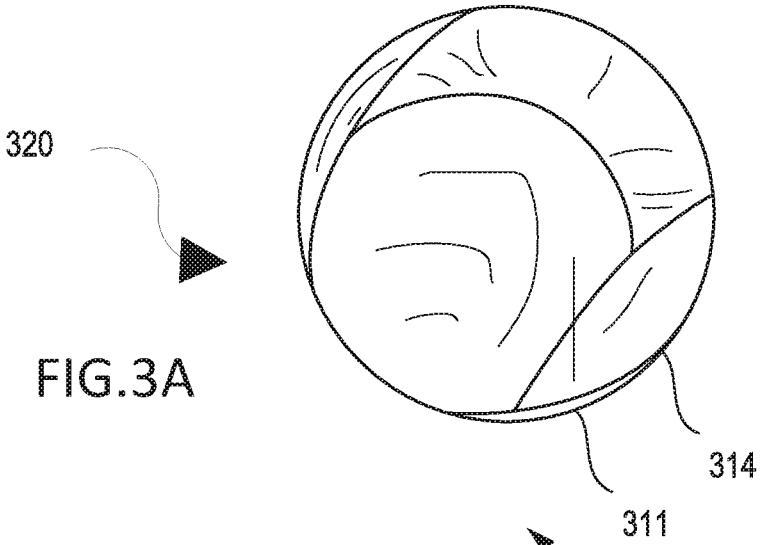
FIGS. 3A-C illustrate, in accordance with various embodiments, various states of deployment of a ballasted bag.
Figure 3B:
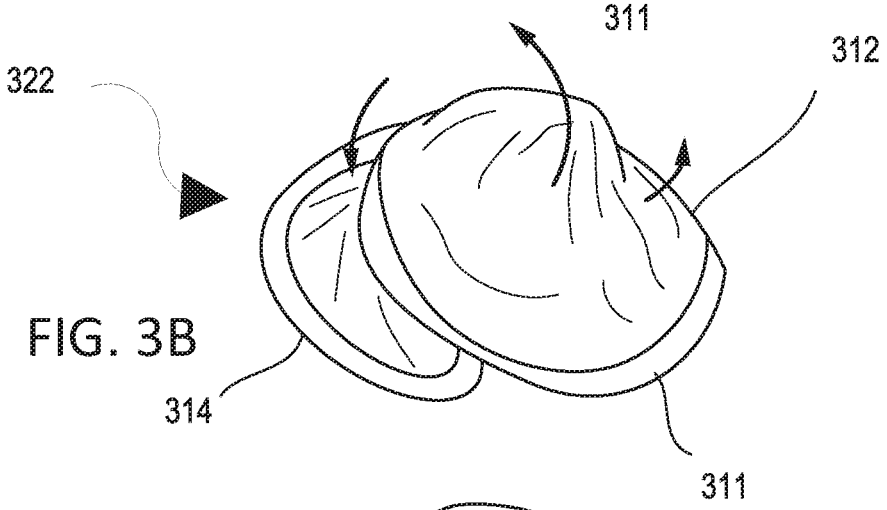
Figure 3C:
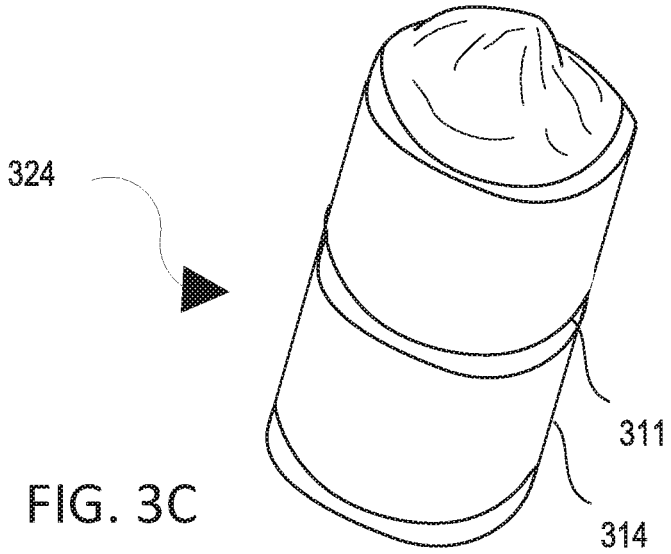

With regards to FIGS. 3A-C, various states of deployment of ballast bag 314 are depicted according to various embodiments. In various embodiments, in FIG. 3A, ballast bag 314 is in a compact state 320. In various embodiments, as can be seen in FIG. 3A, the retention mechanism of ballast bag 314 may be, for example, the unrotated spring 311, which is coupled to ballast bag 314 and keeps ballast bag 314 in a compact state 320. That is, spring 311 may be retained by keeping spring 311 unrotated. Ballast bag 314 is rotated in, for example, a counter clockwise direction from its compact state 320 into a spring state 322 shown in FIG. 3B. In spring state 322, spring 311 expands to allow ballast bag 314 to become erect as shown in FIG. 3C. In erect state 324, ballast bag 314 is able to retain water to allow ballast bag 314 to serve as a weight for life raft 102 of FIG. 1. In various embodiments, at least a ¼ rotation is needed to allow spring 210 to become uncompressed. In various embodiments, a ½ rotation is needed to allow spring 210 to become uncompressed.

In various embodiments, the direction of the first ballast bag 114 is guided as first ballast bag 114 is deployed. Such guidance, may, for example, prevent aging of the material in the pack from preventing the bag from supplied with water.

Figure 4:
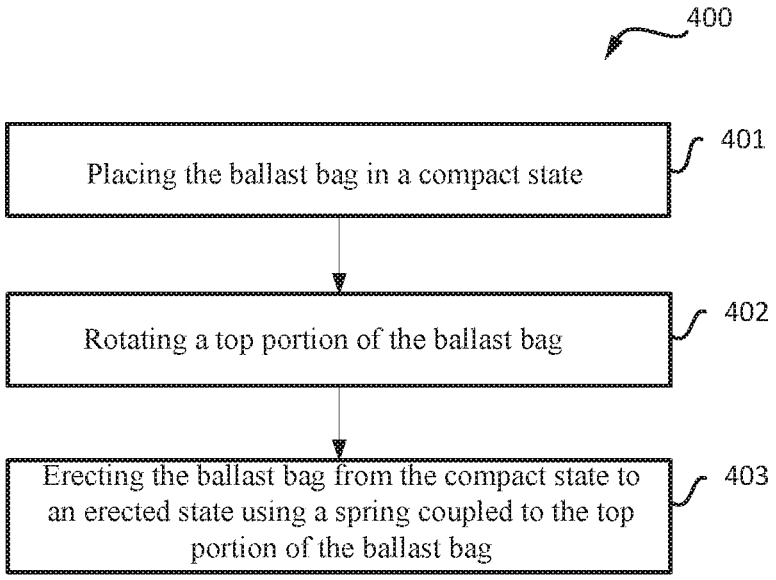
FIG. 4 illustrates, in accordance with various embodiments, a method of erecting a compacted ballasted bag.

With regards to FIG. 4, a method of erecting ballast bag 400 is depicted according to various embodiments. Step 401 includes placing first ballast bag 114 in a compact state. Step 402 includes rotating top portion 230 of first ballast bag 114 to, for example, activate spring 210. Step 403 includes erecting first ballast bag 114 from the compact state to an erected state using spring 210 that is coupled to top portion 230 of first ballast bag 114. In various embodiments, rotating top portion 230 of first ballast bag 114 includes rotating top portion 230 in a counter-clockwise direction to activate spring 210.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. An evacuation system, comprising:
- a life raft; and
- a ballast bag coupled to said life raft, the ballast bag comprising:
  - a top end portion;
  - a center portion coupled to said top end portion;
  - a bottom end portion coupled to said center portion; and
  - a spring coupled to said top end portion and said bottom end portion and encapsulated by said center portion, said spring configured to push said top end portion and said bottom end portion away from said center portion,
  - wherein said ballast bag is capable of expanding from a compacted state to an erected state.

2. The evacuation system of claim 1, wherein said spring is capable of expanding said ballast bag from said compacted state to said erected state.

3. The evacuation system of claim 1, wherein said spring is a cylindrical spring.

4. The evacuation system of claim 1 wherein said ballast bag includes a tubular center portion whose diameter matches a diameter of said spring.

5. The evacuation system of claim 1, wherein said spring is unrotated to yield said compacted state and rotated to yield said erected state.

6. The evacuation system of claim 1, wherein said ballast bag is in said compacted state when said life raft is packaged.

7. The evacuation system of claim 1, wherein said ballast bag is in said erected state when said life raft coupled to said ballast bag is deployed.

8. The evacuation system of claim 1, wherein a pressure is released from a package holding said life raft and said ballast bag in said compacted state to expand said ballast bag to said erected state.

* * * * *